United States Patent [19]

Cox et al.

[11] Patent Number: 4,832,757

[45] Date of Patent: May 23, 1989

[54] METHOD FOR PRODUCING NORMALIZED GRADE D SUCKER RODS

[75] Inventors: Thomas B. Cox, Ann Arbor, Mich.; Richard I. Garber, Houston, Tex.

[73] Assignee: Amax Inc., New York, N.Y.

[21] Appl. No.: 71,109

[22] Filed: Jul. 8, 1987

[51] Int. Cl.[4] ..... C21B 8/06

[52] U.S. Cl. ..... 148/12 B; 148/12 F

[58] Field of Search ..... 148/12 B, 12 F, 909, 148/320; 420/123, 127

[56] References Cited

U.S. PATENT DOCUMENTS 4,486,449 12/1984 Woodings ..... 148/12 B

FOREIGN PATENT DOCUMENTS 53-15214 2/1978 Japan ..... 148/320

*Primary Examiner*—Deborah Yee

*Attorney, Agent, or Firm*—Michael A. Ciomek; Eugene J. Kalil

[57] ABSTRACT

An article of manufacture is provided in the form of a sucker rod for use in sucker rod pumps. The sucker rod is formed of a medium carbon manganese-molybdenum steel consisting essentially of about 0.25% to 0.45% carbon, about 1.2% to 1.8% manganese, about 0.20% to 0.55% molybdenum, up to about 0.03% niobium, and the balance essentially iron, the sucker rod being in the normalized condition and being characterized by a yield to tensile ratio in excess of about 0.572, a tensile strength of at least about 115 ksi, and by a microstructure consisting essentially of acicular ferrite, fine pearlite and bainite.

3 Claims, 5 Drawing Sheets

EFFECT OF TEMPERATURE ON THE CHARPY V-NOTCH IMPACT TOUGHNESS OF EXPERIMENTAL SUCKER ROD STEELS 0.24C-1.21Mn-0.28Si-0.20Mo 0.24C-1.46Mn-0.52Si-0.20Mo 0.38C-1.29Mn-0.56Si-0.20Mo 0.38C-1.48Mn-0.56Si-0.37Mo 0.28C-1.24Mn-0.56Si-0.40Mo 0.28C-1.24Mn-0.56Si-0.40Mo-0.023Nb 0.38C-1.50Mn-0.30Si-0.20Mo 0.38C-1.50Mn-0.30Si-0.20Mo-0.022Nb 0.28C-1.54Mn-0.28Si-0.40Mo 0.37C-1.24Mn-0.28Si-0.40Mo 0.42C-0.75Mn-0.26Si-1.0Cr-0.20Mo

METHOD FOR PRODUCING NORMALIZED GRADE D SUCKER RODS

This invention relates to sucker rods made of manganese-molybdenum steel and, in particular, to sucker rods in the normalized condition characterized by physical properties which meet the requirements of the American Petroleum Institute Grade D sucker rods.

BACKGROUND OF THE INVENTION AND PRIOR ART

Sucker rod pumps are used for oil production in most onshore wells requiring artificial lift. Sucker rods are fabricated by upsetting and forging the ends of a round bar to twice the bar diameter to provide for a threaded connection and a wrench flat for making up the connection.[1] Rods are then heat treated and threaded. Sucker rods are covered by API Specification 11B[2]. Grade D rods are typically normalized and tempered AISI 4142, or quenched and tempered carbon-manganese steel (AISI 1536) with a tensile strength in the 795–965 MPa (115–140 ksi) range.

1. J. T. Winship, "High-Speed Forging of Sucker Rods," American Machinist, September 1979, pp. 90–2. 2. "API Specification for Sucker Rods," API Spec 11B, 18th Edition, American Petroleum Institute, Dallas, Tex. April 1974.

Sucker rod manufacturers have expressed the desire to produce rods with acceptable properties in the as-normalized condition. The properties of the currently produced API Grade D normalized and tempered AISI 4142 rods are: yield strength 655–760 MPa (95–110 ksi), tensile strength 825–930 MPa (120–135 ksi), a minimum elongation of ten percent, and a minimum reduction in area of fifty percent. A normalized rod which matched these Grade D properties would clearly be acceptable. However, in the as-normalized condition it will be impossible to match the high yield to tensile ratio achieved in a normalized and tempered product. It is desirable to have the yield/tensile ratio exceed a value of 0.572, since the modified Goodman diagram recommended for sucker rods by API RP 11BR sets the maximum allowable stress in fatigue at 0.572 times the tensile strength.

Medium carbon (0.3–0.4C) manganese-molybdenum (1.5Mn, 0.2 Mo) steels are attractive candidates for normalized sucker rods, as they have sufficient hardenability to produce the bainitic phase as cooled structures with relatively high tensile strength. Such steels have long been used for oil country tubular goods in the United States and for automotive parts in the United Kingdom, where they have been standardized as the En 16 and En 17 grades.[3]

3. G. F. P. Fox, "En 16 and En 17 ... Two English Automotive Steels," Metal Progress, Vol. 85, No. 1, 1964, pp. 103–106.

The 0.3–0.4C, manganese-molybdenum steels are capable of achieving grade D tensile properties in the as-normalized condition. For example, Woolman and Mottram[4] found that an air cooled 64 mm (2.5 in.) round of an En 16 steel (0.35C-1.49Mn-0.27Mo) had a yield strength of 530 MPa (77 ksi), a tensile strength of 890 MPa (129 ksi), an elongation of 20%, and a reduction in area of 39.5%. It has been found that an air cooled 25 mm (1 in.) round of a 0.33C-1.51Mn-0.60Mo steel had a yield strength of 500 MPa (72 ksi), a tensile strength of 845 MPa (122 ksi), an elongation of 16% and a reduction in area of 47.5%. Both steels have yield to tensile ratios above 0.572.

4. J. Woolman and R. A. Mottram, The Mechanical and Physical Properties of the British Standard En Steels, Pergamon Press, 1964, p. 289.

OBJECTS OF THE INVENTION

It is an object of the invention to provide a sucker rod formed of a manganese-molybdenum steel in the as-normalized condition that meets the tensile requirements of the American Petroleum Institute Grade D sucker rod material.

It is a further object of this invention to provide a low cost sucker rod alternative to the presently used sucker rod steels (that is, normalized and tempered AISI 4142 and quenched and tempered AISI 1536).

The invention further contemplates providing as an article of manufacture a sucker rod steel that not only meets the tensile requirements for Grade D sucker rods but also exhibits fatigue resistance and toughness equivalent to that found in normalized and tempered Grade D sucker rods. A method for producing the sucker rod is also provided.

Other objects and advantages will become apparent from the following description taken in conjunction with the accompanying drawings in which:

FIG. 1 depicts the relationship between hardness and yield (open circles) and tensile (filled circles) strengths for test steels;

FIG. 2 graphically illustrates the effect of temperature on the Charpy V-Notch Impact Toughness of experimental sucker rod steels;

FIG. 3*a* to 3*k* show the optical micrographs of the experimental steels at ×500 magnification following etching with a methyl alcohol solution containing 4% picric acid and 1% nitric acid.

SUMMARY OF THE INVENTION

Generally speaking, the invention is directed to a sucker rod for use in sucker rod pumps. The sucker rod is formed of medium carbon manganese-molybdenum steel consisting essentially of about 0.25% to 0.45% carbon, about 1.2% to 1.8% manganese, about 0.20% to 0.55% molybdenum, up to about 0.03% niobium, and the balance essentially iron, the sucker rod, which is used in the normalized condition, is characterized by a yield to tensile ratio in excess of about 0.572, a tensile strength of at least 115 ksi and by a microstructure consisting essentially of acicular ferrite, fine pearlite and bainite.

The desired physical properties are obtained by normalizing the steel at 900° C. (1650° F.) for about 15 minutes and air cooling. This steel meets the tensile requirements for Grade D sucker rods and exhibits fatigue resistance and toughness equivalent to that found in normalized and tempered Grade D sucker rods. The normalizing temperature may comprise an austenitizing temperature of 30° to 55° C. above the $Ac_3$ temperature, that is ranging from about 830° C. to 975° C. for about 10 minutes to 2 hours.

The microstructure of the new steels consists of a mixture of acicular ferrite, fine pearlite and bainite. As the carbon, manganese and molybdenum contents are increased within the composition range claimed, the as-normalized steel tends to contain monoacicular ferrite, a finer pearlite and bainite.

Another embodiment of the invention is directed to a method for producing sucker rods for use in sucker rod pumps characterized by a yield to tensile strength ratio in excess of about 0.572 and a microstructure consisting essentially of acicular ferrite, fine pearlite and bainite. The method comprises providing a hot worked rod of an alloy of a medium carbon manganese-molybdenum steel consisting essentially of about 0.25% to 0.45% carbon, about 1.2% to 1.8% manganesse, about 0.20% to 0.55% molybdenum, up to about 0.03% niobium and the balance essentially iron and a upsetting or both ends of said rod to provide an enlarged coupling section. The rod is then normalized by heating it to an austenitizing temperature for a time sufficient to convert the microstructure thereof to austenite followed by air cooling to provide a microstructure consisting essentially of acicular ferrite, fine pearlite and bainite. The thus-treated rod is the machine to provide a sucker rod.

DETAILED DESCRIPTION OF THE INVENTION

Figure 1:
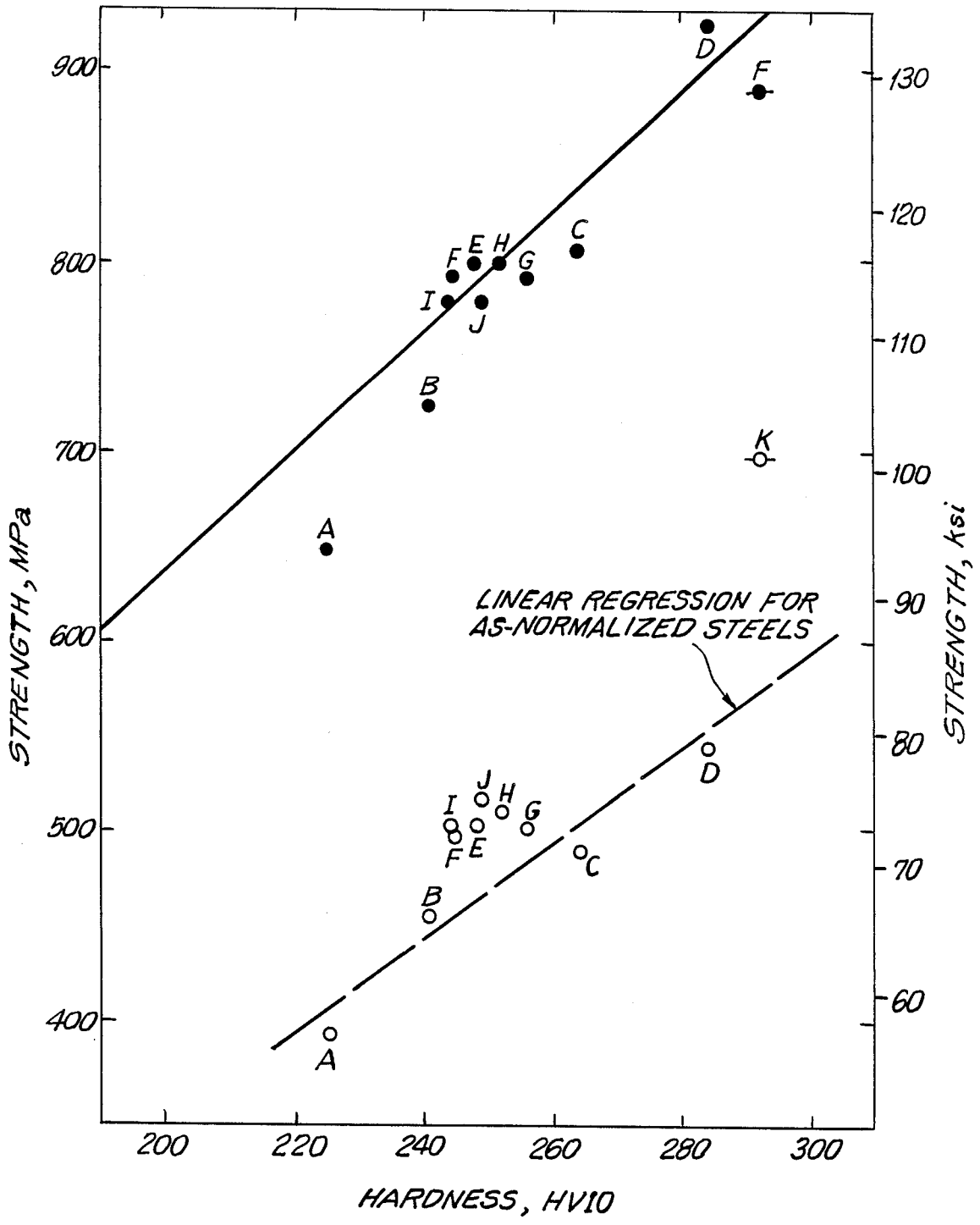

A series of eleven steel compositions were chosen for investigation (Table 1). These included eight compositions forming a fractional design with four factors each at two levels: carbon (0.3,0.4%), manganese (1.2,1.5%), silicon (0.3,0.5%), and molybdenum (0.2,0.4%). Two split heats from the above eight steels had niobium additions to investigate the effect of grain size on strength and impact toughness. Normalized and tempered AISI 4142 prepared under a previous assignment was also evaluated for comparison.

TABLE 1

| | | | Compositions of Experimental Sucker Rod Steels | | | | | | | |
|---|---|---|---|---|---|---|---|---|---|---|
| ID. | Heat | C | Mn | Si | Cr | Mo | Nb | P | S | N |
| A | 6869A | 0.24 | 1.21 | 0.28 | 0.003 | 0.20 | — | 0.014 | 0.119 | 0.0137 |
| B | 6869B | 0.24[a] | 1.46 | 0.52 | — | 0.20[a] | 0.014[a] | 0.119[a] | 0.0137[a] | |
| C | 6870A | 0.38 | 1.29 | 0.56 | — | 0.20 | — | 0.013 | 0.016 | 0.0084 |
| D | 6870B | 0.38[a] | 1.48 | 0.56 | — | 0.37 | — | 0.013[a] | 0.016[a] | 0.0084[a] |
| E | 6871A | 0.28 | 1.24 | 0.56 | — | 0.40 | — | 0.013 | 0.016 | 0.0073 |
| F | 6871B | 0.28[a] | 1.24[a] | 0.56[a] | | 0.40[a] | 0.023 | 0.013[a] | 0.016[a] | 0.0073[a] |
| G | 6872A | 0.38 | 1.50 | 0.30 | — | 0.20 | — | 0.012 | 0.016 | 0.0087 |
| H | 6872B | 0.38[a] | 1.50[a] | 0.30[a] | | 0.20[a] | 0.022 | 0.012[a] | 0.016[a] | 0.0087[a] |
| I | 6873 | 0.28 | 1.54 | 0.28 | — | 0.40 | — | 0.013 | 0.017 | 0.0058 |
| J | 6874 | 0.37 | 1.24 | 0.28 | — | 0.40 | — | 0.012 | 0.016 | 0.0050 |
| K | P2996 | 0.42 | 0.75 | 0.26 | 1.01 | 0.20 | — | 0.008 | 0.010 | 0.0036[b] |

[a]Not analyzed, but assumed same as other split
[b]Also contained 0.017 Al

One of the steels (steel K) used in this investigation, the AISI 4142, was prepared as a 30 kg (66 lb) heat in an induction furnace which was under a positive pressure of argon gas. All other steels were prepared as 37.8 kg (83.3 lb) air induction furnace heats. Charge materials were electrolytic iron, graphite, chromium, nickel, and ferroalloys (ferromanganese, ferrosilicon, ferromolybdenum and ferroniobium). Iron sulfide, iron phosphide, and manganese nitride were added to produce typical commercial levels of sulfur, phosphorus, and nitrogen. The AISI 4142 was aluminum killed, but all other heats were silicon deoxidized. All steels were cast as two 89 mm (3.5 in.) diameter cylindrical ingots using 13 mm (0.5 in.) wall thickness steel pipe molds on copper chill bases. The ingots were then cut in half, lathe turned to a diameter of 79.4 mm (3.12 in.), and then direct extruded at 1150° C. (2100° F.) in an 82.5 mm (3.25 in.) diameter container to produce 22 mm (0.88 in.) diameter round bar, except for the AISI 4142 which was extruded to 25 mm (1.0 in.) round bar. Compositions of the steels are shown in Table 1. A full analysis was obtained for the "A" splits. The "B" splits were analyzed only for the additional elements.

All of the steels except the AISI 4142, Steel K, were double normalized. They were heat treated by austenitizing at 925° C. (1700° F.) for 15 minutes and then air cooling, followed by a final austenitizing at 900° C. (1650° F.) for 15 minutes, followed by air cooling. Steel K (AISI 4142) was normalized by holding for one hour at 925° C. (1700° F.) and air cooling, followed by tempering for one hour at 530° C. (985° F.), and air cooling.

Room temperature longitudinal tensile properties were determined in duplicate using round specimens with a gauge diameter of 6.35 mm (0.25 in.) and a gauge length of 25.4 mm (1.0 in.). Specimens were tested at an average strain rate of 18%/hr in the elastic range and 300%/hr in the plastic range. The yield strengths at 0.2% offset and at 0.5% total strain were determined, as were the tensile strengths, percent elongation and percent reduction in area.

Vickers hardness using a 10 kg load , HV10, was determined on metallographically prepared sections of all steels. Three impressions were made, and the results were averaged.

The impact toughness of Steels A, D, G, H, and K was determined using standard v-notch Charpy specimens. Triplicate tests were run at room temperature, 20° C. (68° F.). In addition transition curves were determined by conducting tests at 25° C. (45° F.) intervals over temperatures ranging from −25° C. to 150° C. (−13° F. to 300° F.) but excluding 25° C. (68° F.).

The cyclic plastic behavior of Steels A, D, G, H, and K was determined using incremental step tests (IST) which were performed in fully-reversed strain control using a constant strain rate of 0.01/sec. The specimens were cycled once at ±1.0%, ±0.94%, ±0.88%, ±0.16%, and ±0.1% total strain amplitudes resulting in fifteen ±0.06% strain increments for each "unloading" IST block. The specimens were then reloaded starting with +0.1% total strain amplitude and continuing in a similar progression to ±1.0% total strain amplitude. The entire process was repeated until the cyclic stress-strain curve (on unloading) was stabilized, i.e., no changes in the load-strain values between the last two unloading IST blocks were observed. The 0.2% offset yield strength was determined for the selected materials from the last unloading IST block for each and compared with the offset yield strength determined on the first loading cycle as a measure of its resistance to low cycle fatigue.

Samples of all the steels in the final heat treated condition were prepared for optical metallographic examination using standard mechanical polishing techniques. Specimens were etched with a solution of four percent picric acid and one percent nitric acid in methyl alcohol (4PIN).

RESULTS

Tensile Properties and Hardness

Results of the tensile tests are presented in Table 2. All of the steels except A, B, I and J met or exceeded the minimum allowable tensile strength for API Grade D sucker rods, which is 795 MPa (115 ksi). However, the yield strength of the as-normalized steels was significantly lower than that of the normalized and tempered AISI 4142, Steel K. The yield to tensile strength ratios of the as-normalized steels varied from 0.590 to 0.664, all exceeding the desired value of 0.572, while the normalized and tempered AISI 4142 had a yield to tensile ratio of 0.783.

TABLE 2

Room Temperature Mechanical Properties of Experimental Sucker Rod Steels

| ID. | Heat | 0.2% Offset Yield Strength, MP/a (ksi) | 0.5% Yield Strength, MPa (ksi) | Tensile Strength, MPa (ksi) | Offset Yield/ Tensile Ratio | El. % | Red. of Area, % | Hardness, HV10 | Charpy Impact Energy J |
|---|---|---|---|---|---|---|---|---|---|
| A | 6869A | 395 (57) | 415 (60) | 650 (94) | 0.606 | 25.0 | 52.0 | 225 | 21 (15) |
| B | 6869B | 450 (66) | 470 (68) | 725 (105) | 0.629 | 26.5 | 44.5 | 241 | — |
| C | 6870A | 485 (71) | 500 (72) | 810 (117) | 0.606 | 21.5 | 35.5 | 264 | — |
| D | 6870B | 545 (79) | 570 (83) | 925 (134) | 0.590 | 17.0 | 32.5 | 284 | 7 (5) |
| E | 6871A | 505 (73) | 515 (75) | 800 (116) | 0.629 | 24.0 | 48.0 | 248 | — |
| F | 6871B | 500 (72) | 515 (75) | 795 (115) | 0.626 | 24.0 | 48.0 | 245 | — |
| G | 6872A | 505 (73) | 520 (75) | 795 (115) | 0.635 | 16.0 | 34.5 | 256 | 11 (8) |
| H | 6872B | 515 (74) | 525 (76) | 800 (116) | 0.638 | 19.5 | 46.5 | 252 | 20 (15) |
| I | 6873 | 510 (74) | 525 (76) | 775 (113) | 0.655 | 20.0 | 55.5 | 244 | — |
| J | 6874 | 515 (75) | 550 (80) | 780 (113) | 0.644 | 20.0 | 52.0 | 249 | — |
| K | P2996 | 695 (101) | 695 (101) | 890 (129) | 0.783 | 16.5 | 55.0 | 292 | 25 (19) |

Hardness, HV10, is also shown in Table 2. The relationships between the 0.2% offset yield strength and hardness, and the tensile strength and hardness, are shown in FIG. 1. This figure also shows the correlation between tensile strength and hardness as published by, SAE[5] which fits the data reasonably well. A linear regression analysis of the hardness of the as-normalized steels is shown in FIG. 1. Extrapolation of this line shows that the yield strength of an as-normalized steel is about 120 MPa (17 ksi) lower than that of the tempered 4142 steel at the same tensile strength (hardness).

5. "Hardness Tests and Hardness Number Conversions," SAE J 417b, 1979.

The effects of carbon, manganese, silicon, and molybdenum additions on the yield and tensile strengths and hardness were determined using the Yates method[6] to analyze the eight heats forming a half factorial design. Calculated effects are shown in Table 3. Carbon has the largest effect followed by molybdenum on the 0.2% offset, the 0.5% extension yield strength and the tensile strength of the alloys tested.

6. M. G. Natrella, Experimental Statistics, National Bureau of Standards Handbook #91, U.S. Government Printing Office, Washington, DC, 1963, pp. 12–19.

TABLE 3

Alloy Effect per Weight Percent Addition on Yield Strength, Tensile Strength, and Hardness

| Element | 0.2% Offset Yield Strength MPa (ksi) | 0.5% Yield Strength, MPa (ksi) | Tensile Strength, MPa (ksi) | Hardness, HV | Predicted Effect on HV, from Ref. 7: Bainite | Predicted Effect on HV, from Ref. 7: Ferrite-Pearlite |
|---|---|---|---|---|---|---|
| C | 402 (58.3) | 445 (64.6) | 750 (108.8) | 197.9 | 385 | 223 |
| Mn | 110 (16.0) | 103 (15.0) | 181 (26.2) | 39.0 | 70 | 30 |
| Si | 65 (9.4) | 46 (6.6) | 246 (35.7) | 59.4 | 122 | −19 |
| Mo | 304 (44.0) | 348 (50.5) | 388 (56.3) | 50.5 | 66 | 19 |
| Const. | 93 (13.5) | 102 (14.7) | 78 (11.3) | 94.9 | | |

7. P. Maynier, B. Jungmann, and J. Dollet, "Creusot-Loire System for the Prediction of the Mechanical Properties of Low Alloy Steel Products," in Hardenability Concepts with Applications to Steel, TMS-AIME, 1978, pp. 518–44.

Figure 2:
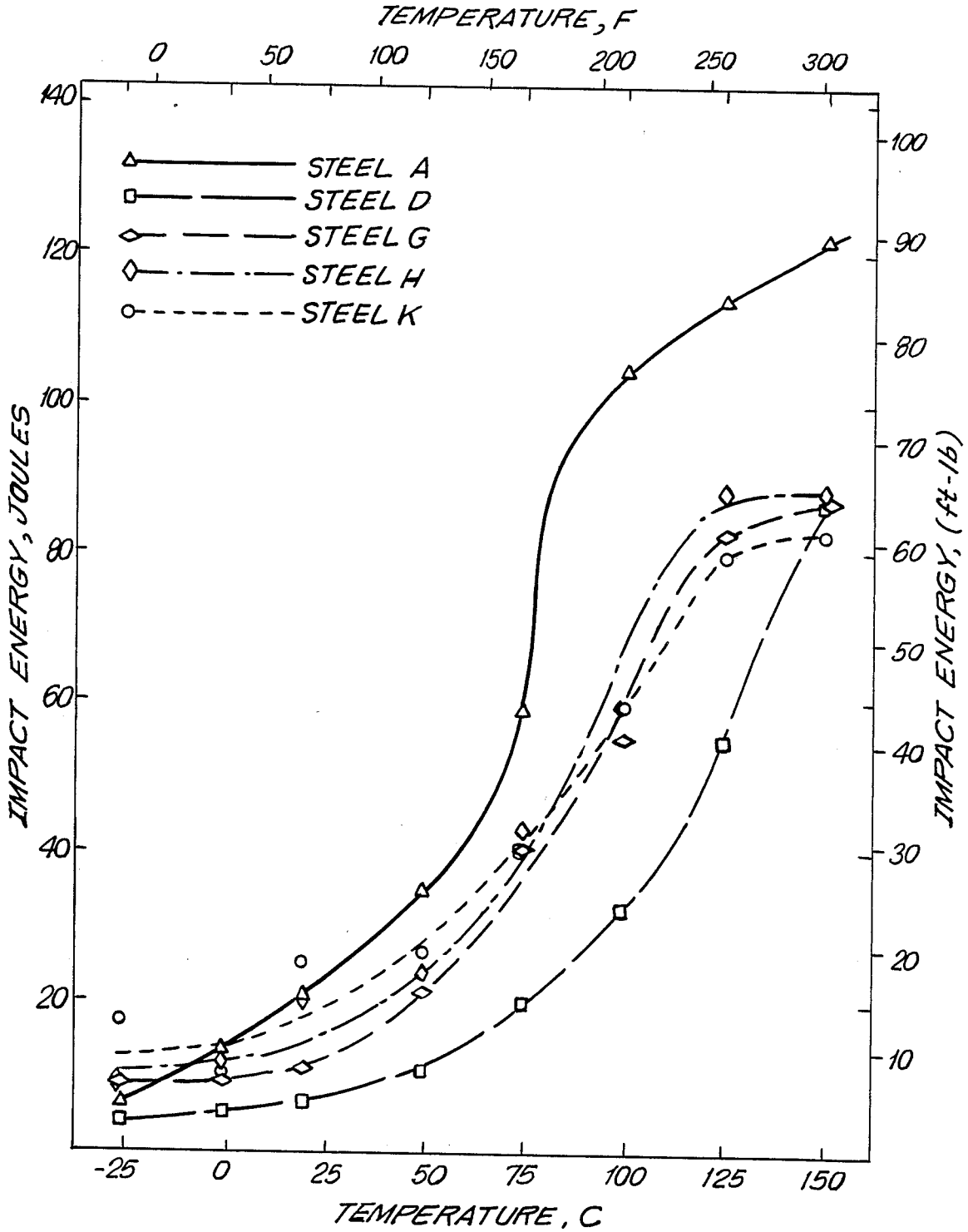

Results of the Charpy impact tests are presented in Table 4 and plotted in FIG. 2. As would be expected, the lowest strength as-normalized steel, Steel A, has the highest toughness while the highest strength as-normalized steel, Steel D, has the lowest toughness. The normalized and tempered 4142, Steel K, although having the highest yield strength toughness in the middle of the band.

TABLE 4

Results of Individual Charpy Impact Tests on Experimental Sucker Rod Steels

| Test | Steel and Impact Energy, J (ft-lb) | | | | | |
|---|---|---|---|---|---|---|
| Temp. °C. (°F.) | 6869A (Steel A) | 6870B (Steel D) | 6872A (Steel G) | 6872B (Steel H) | P2996 (Steel K) | |
| −25 (−13) | 7 (5) | 4 (3) | 9 (7) | 9 (7) | 18 (13) | |
| 0 (32) | 14 (10) | 5 (4) | 9 (7) | 12 (9) | 11 (8) | |
| 20 (68) | 22 (16) | 7 (5) | 11 (8) | 23 (17) | 22 (16) | |
| 20 (68) | 19 (14) | 7 (5) | 11 (8) | 16 (12) | 28 (21) | |
| 20 (68) | 22 (16) | 7 (5) | 12 (9) | 22 (16) | 26 (19) | |
| 50 (122) | 35 (26) | 11 (8) | 22 (16) | 24 (18) | 27 (20) | |
| 75 (167) | 60 (44) | 20 (15) | 41 (30) | 43 (32) | 41 (30) | |
| 100 (212) | 104 (77) | 33 (24) | 56 (41) | 60 (44) | 60 (44) | |
| 125 (257) | 114 (84) | 56 (41) | 83 (61) | 88 (65) | 80 (59) | |
| 50 (302) | 122 (90) | 87 (64) | 87 (64) | 88 (65) | 83 (61) | |

As seen in Table 5, the 27 J (20 ft-lb) Charpy transition temperatures of the as-normalized steels ranged from 35° C. (90° F.) to 90° C. (190° F.) as compared with 50° C. (120° F.) observed for the normalized and tempered 4142 steel.

TABLE 5

| Comparison of 27 J (20 ft-lb) Transition Temperatures of Experimental Sucker Rod Steels | | |
|---|---|---|
| ID. | Heat | T, °C. (°F.) |
| A | 6869A | 35 (90) |
| D | 6870B | 90 (190) |
| G | 6872A | 60 (140) |
| H | 6872B | 55 (130) |
| K | P2996 | 50 (120) |

The results of the incremental step tests are presented in Table 6. There are no dramatic differences between the yield strengths determined by monotonic loading and cyclic loading. Steel A exhibited modest cyclic hardening as would be expected of a material with substantial quantities of polygonal ferrite in its structure.[8] Modest cyclic softening was observed for Steels G and H while Steels D and K (the 4142 normalized and tempered steel) showed no effect of cyclic straining on yield strength. This last observation suggests that Steel D, 0.38C-1.48Mn-0.56Si-0.37Mo, would exhibit resistance to low cycle fatigue comparable to the Standard Grade D sucker rod material, AISI 4142 steel, as their cyclic yield strengths are equal.

8. N. S. Stolloff and D. J. Duquette, "Microstructural Effects in the Fatigue Behavior of Metals and Alloys," CRC Critical Reviews in Solid State Sciences, Issue 4, 1974, pp. 615–687.

TABLE 6

| Results of Incremental Step Tests on Selected Steels | | | |
|---|---|---|---|
| ID. | Heat | Monotonic 0.2% Offset Yield Strength, MPa (ksi) | Cyclic 0.2% Offset Yield Strength, MPa (ksi) |
| A | 6869A | 401 (58.2) | 444 (64.4) |
| D | 6870B | 550 (79.8) | 558 (80.9) |
| G | 6872A | 505 (73.3) | 478 (69.4) |
| H | 6872B | 505 (73.3) | 449 (65.2) |
| K | P2996 | 548 (79.5) | 563 (81.6) |

It should be noted that the yield strength of the 4142 steel, Steel K, determined on the first loading cycle of the incremental step test was 548 MPa (79.5 ksi), about 20% lower than the yield strength reported in Table 2. Metallographic examination of the fatigue specimen revealed a substantial quantity of acicular ferrite in the microstructure as a contrasted with the nearly fully bainitic structure in the tensile test specimen. The tensile strength of the structure in the fatigue specimen was determined by hardness to be equal to that reported in the tensile test. As prior work has shown that low cycle fatigue resistance (described by the cyclic yield strength) is controlled by tensile strength, the conclusions drawn regarding the equivalent behavior of Steel D and the 4142 steel would appear to be valid.

Figure 3A:
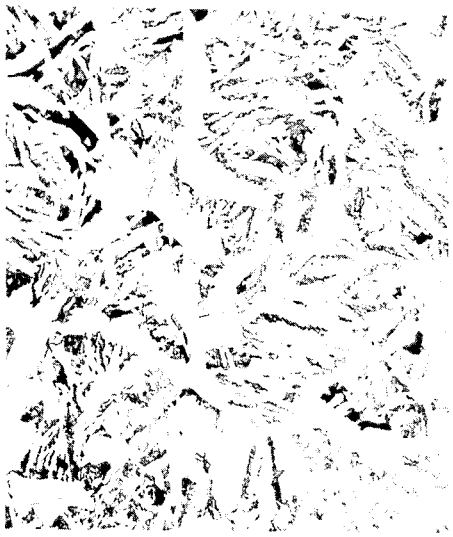
Figure 3B:
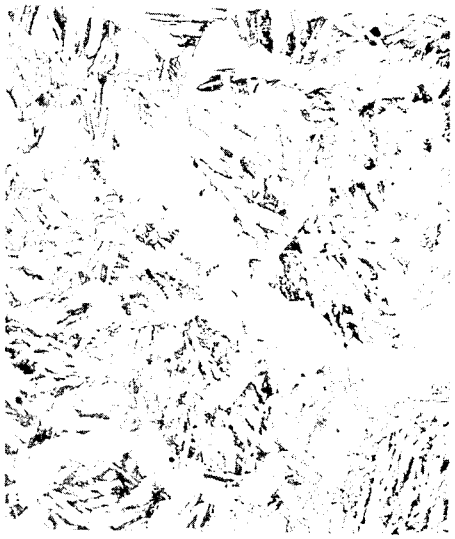
Figure 3C:
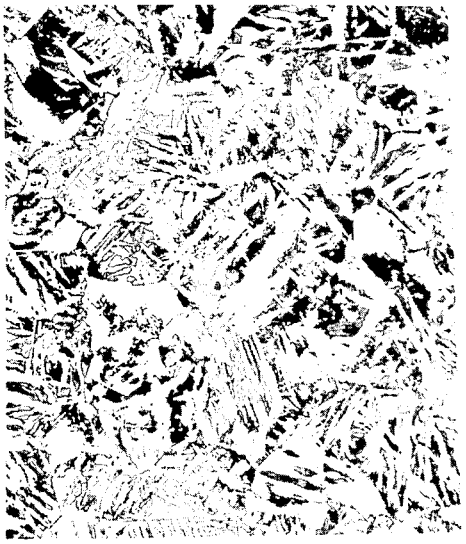
Figure 3D:
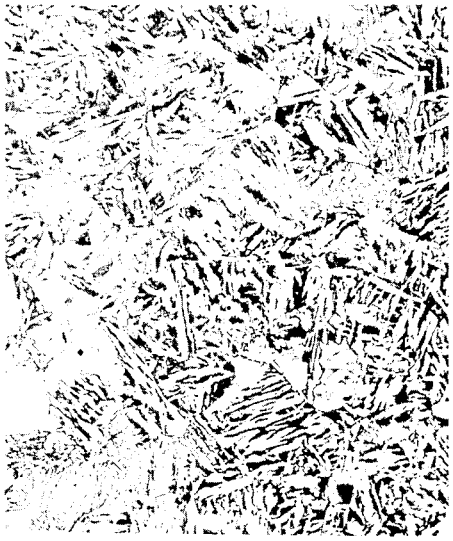
Figure 3E:
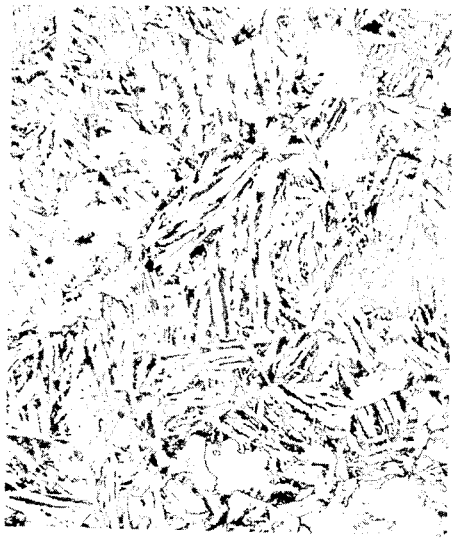
Figure 3F:
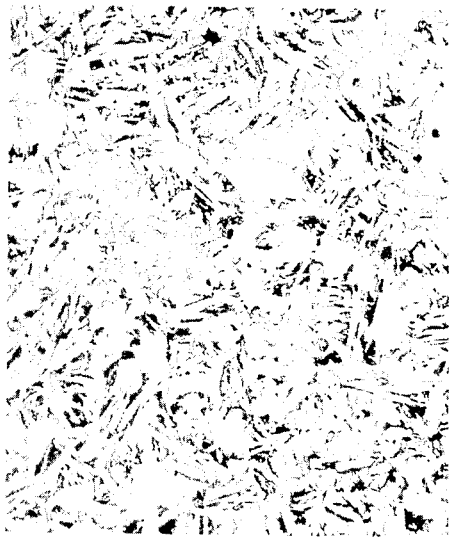
Figure 3G:
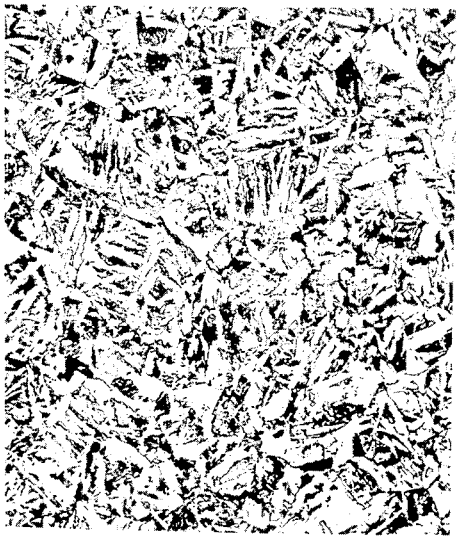
Figure 3H:
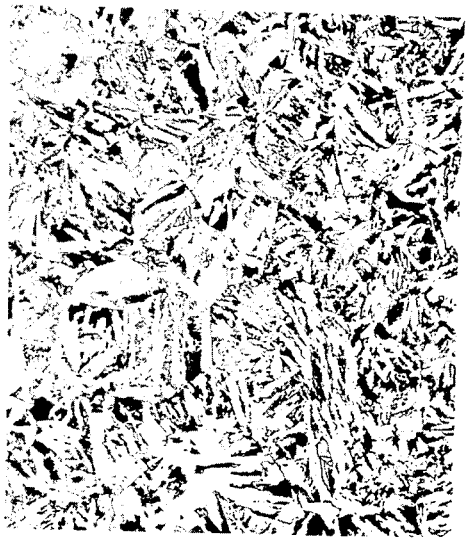
Figure 3I:
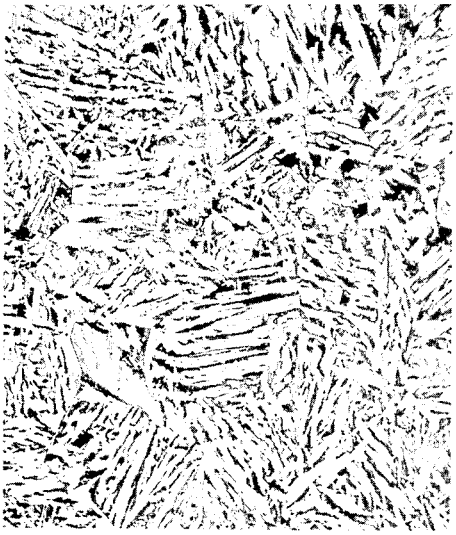
Figure 3J:
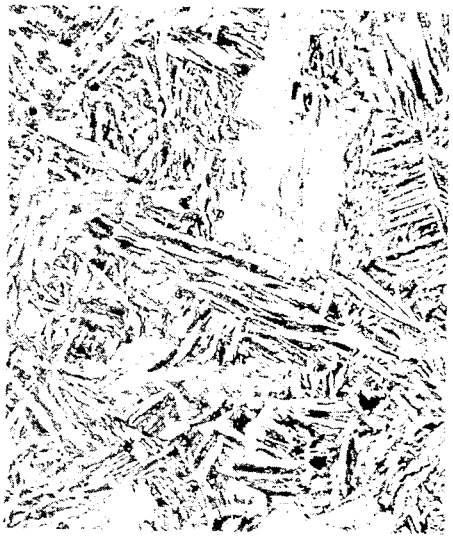
Figure 3K:
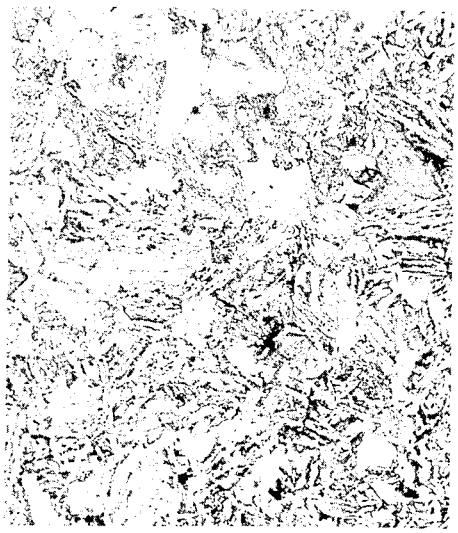

Optical micrographs of the steels are shown for Steels A and B in FIGS. 3*a* and 3*b* have structures consisting of a mixture of coarse polygonal ferrite, pearlite, and acicular ferrite. These steels exhibited the lowest yield strengths of the as-normalized steels. With increasing carbon, manganese and molybdenum contents the structures of the as-normalized steels tend to contain more acicular ferrite, a finer pearlite and bainite as can be seen in the progression of structures from FIG. 3*c* through 3*j*. Steel D, 0.38C-1.48Mn-0.56Si-0.37Mo, FIG. 3*d* had the finest microstructure and the highest yield strength of the as-normalized steels. Steels F and H, FIG. 3*f* and 3*h*, which contain niobium as a possible grain refiner have coarser grain sizes than several of the other as-normalized steels. The reason for the failure of niobium to refine the grain size is unknown, but may have resulted from the presence of large carbides/nitrides of niobium rather than a fine dispersion. Steel K, the normalized and tempered AISI 4142 steel, FIG. 3*k*, has the highest hardenability of the steels investigated with 0.42% C, 0.75% Mn, 1% Cr and 0.20% Mo and exhibits a nearly fully bainitic microstructure and the highest yield strength of all the test steels.

The yield strengths of the as-normalized steels studied here are lower than previously obtained results on aluminum killed Mn-Mo steels developed for ERW N-80 casing. For example, it has been observed that a commercial heat of normalized 0.36C-1.51Mn-0.2Mo steel cooled at 44° C./min had a 0.2% offset yield strength of 590 MPa (85 ksi), versus the value of 520 MPa (75 ksi) found for Steel G (0.38C-1.50Mn-0.2Mo) in this investigation. This difference in yield strength probably is due to the silicon deoxidized steels of this study having considerably coarser grain sizes than the aluminum killed steels studied previously. Little variation in tensile strength was noted as the normalizing temperature was increased, and the prior austenite grain size increased. The present work confirms this observation in that the values of tensile strength of the as-normalized steels studied have been noted to be comparable to those in the aluminum killed steels.

The effects of alloying on the mechanical properties of the as-normalized Mn-Mo steels, as shown in Table 3, are due to changes in microstructure and solid solution strengthening. It is of interest to compare the coefficients for hardness determined in this study with those given by Maynier, Jungmann, and Dollet[7] for determining the hardness of bainitic or ferritic-pearlitic microstructures. Table 3 shows their coefficients evaluated at a cooling rate of 6000° C./hr, which corresponds to air cooling of a 22 mm (0.88 in) diameter bar. There is good agreement as the effects measured in this study lie between those predicted by Maynier, et al., for bainitic and ferritic-pearlitic microstructures.

Steel D, 0.38C-1.48Mn-0.56Si-0.37Mo, appears to be the most promising candidate for an as-normalized sucker rod material. It exhibits tensile strength and fatigue resistance comparable to the Grade D sucker rod steel, normalized and tempered AISI 4142. Both its yield strength and impact toughness would be improved by refining its grain size which could be accomplished by aluminum killing if compatible with the casting technique used in production. If the steel cannot be aluminum killed, then the grain size may be refined by lowering the austenitizing temperature to below the 925° C. (1700° F.) used here and/or using another grain refining agent such as niobium or titanium. In any event, the properties of the steel developed in this investigation make it a strong candidate as an as-normalized sucker rod material.

Based on the linear regression equation for tensile strength shown in Table 3, it is possible to estimate that a wide variety of commercially feasible composition ranges can be used to achieve tensile strengths greater than 115 ksi. Table 7 shows nine such compositions.

TABLE 7

| Suggested Compositions for tensile strength range of 115 to 135 ksi, all with 0.2 to 0.34% Silicon | | | |
|---|---|---|---|
| No. | Carbon | Manganese | Molybdenum |
| I | 0.35–0.40 | 1.20–1.40 | 0.50–0.55 |
| II | 0.40–0.45 | 1.20–1.40 | 0.40–0.45 |
| III | 0.30–0.35 | 1.40–1.60 | 0.50–0.55 |

TABLE 7-continued

| Suggested Compositions for tensile strength range of 115 to 135 ksi, all with 0.2 to 0.34% Silicon | | | |
|---|---|---|---|
| No. | Carbon | Manganese | Molybdenum |
| IV | 0.35–0.40 | 1.40–1.60 | 0.40–0.45 |
| V | 0.40–0.45 | 1.40–1.60 | 0.30–0.35 |
| VI | 0.25–0.30 | 1.60–1.80 | 0.50–0.55 |
| VII | 0.30–0.35 | 1.60–1.80 | 0.40–0.45 |
| VIII | 0.35–0.40 | 1.60–1.80 | 0.30–0.35 |
| IX | 0.40–0.45 | 1.60–1.80 | 0.20–0.25 |

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A method for producing a sucker rod for use in sucker rod pumps characterized by a yield to tensile strength ratio in excess of about 0.572 and a microstructure consisting essentially of acicular ferrite, fine pearlite and bainite which comprises, providing a hot worked rod of an alloy of a medium carbon manganese-molybdenum steel consisting essentially of about 0.25% to 0.45% carbon, about 1.2% to 1.8% manganese, about 0.20% to 0.55% molybdenum, up to about 0.03% niobium and the balance essentially iron, upsetting one or both ends of said rod to provide enlarged coupling sections, normalizing said rod by heating it to an austenitizing temperature for a time sufficient to obtain a microstructure consisting essentially of acicular ferrite, fine pearlite and bainite, and a tensile strength of at least about 115 ksi, and machining said upset rod to form a sucker rod.

2. The method of claim 1, wherein the normalizing temperature ranges from about 830° C. to 975° C. for about 10 minutes to 2 hours.

3. The method of claim 2, wherein the steel rod is normalized at 900° C. for about 15 minutes and then air cooled.

* * * * *